United States Patent [19]

Hofstetter

[11] Patent Number: 4,630,409

[45] Date of Patent: Dec. 23, 1986

[54] DEVICE FOR FINISHING THE EDGES OF SKIS

[76] Inventor: Michel Hofstetter, 3, Rue Eveche, 1204 Geneva, Switzerland

[21] Appl. No.: 752,649

[22] Filed: Jul. 8, 1985

[30] Foreign Application Priority Data

Dec. 9, 1982 [CH] Switzerland ..... 7159/82

[51] Int. Cl.[4] ..... B24D 15/00

[52] U.S. Cl. ..... 51/361; 51/392; 51/205 WG; 29/80; 76/88

[58] Field of Search ..... 51/181 R, 205 R, 205 WG, 51/241 G, 241 S, 241 R, 358, 359, 360, 361, 391, 392; 29/78, 80; 76/83, 88; 30/172, 287; 280/809

[56] References Cited

U.S. PATENT DOCUMENTS

| | | | |
|---|---|---|---|
| 1,691,418 | 11/1928 | White | 51/361 |
| 3,585,760 | 6/1971 | Richmond | 51/241.5 X |
| 3,766,649 | 10/1973 | Winbauer | 30/172 X |
| 3,813,830 | 6/1974 | Hodge | 51/392 |
| 3,875,825 | 4/1975 | Buttafuoco | 51/205 WG X |
| 3,899,942 | 8/1975 | Bradbury | 76/83 X |
| 3,991,429 | 11/1976 | Honauer | 76/83 X |
| 4,030,382 | 6/1977 | Nilsson et al. | 51/205 WG X |
| 4,442,636 | 4/1984 | Obland | 51/205 WG |

FOREIGN PATENT DOCUMENTS

| | | | |
|---|---|---|---|
| 2143860 | 3/1972 | Fed. Rep. of Germany | 51/241 G |
| 2653944 | 6/1978 | Fed. Rep. of Germany | . |
| 2230385 | 12/1974 | France | . |
| 2354111 | 1/1978 | France | . |

*Primary Examiner*—Robert P. Olszewski

*Attorney, Agent, or Firm*—Young & Thompson

[57] ABSTRACT

A device for finishing the edges of a ski, comprising a base plate displaceable relative to the sliding surface of the ski, the base plate having on its lower surface two blocks on opposite sides of the device, the lower surfaces of the blocks being inclined toward each other each at an angle of about 0.5° to 3°. Guide rollers on opposite sides of the device engage the lateral edges of the ski. Two reels for abrasive strips are rotatable on supports attached to the upper face of the base plate. In operation, each block is covered with a length of abrasive band the free end of which is fixed by a clamping device on the base plate. Alternatively, the blocks can be in the form of removable files. Handles are disposed at either side of the block for moving it lengthwise of the ski. The handles are movable toward and away from each other and are secured to the guide rollers, so that spreading the handles spreads the rollers to release the ski. Springs urge the rollers toward each other.

3 Claims, 5 Drawing Figures

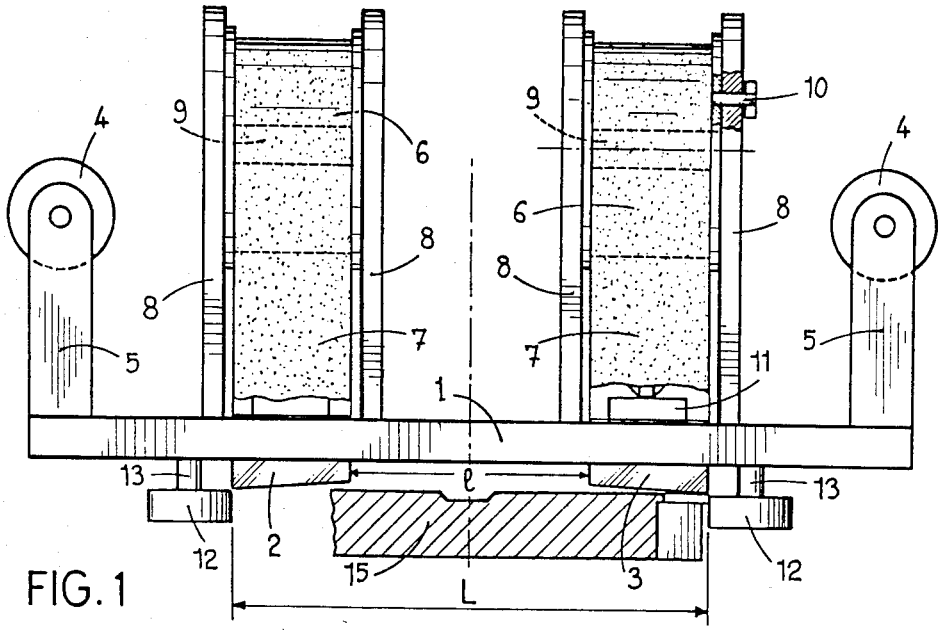
FIG. 1
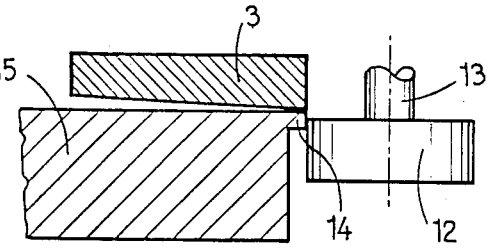
FIG. 2
FIG. 3
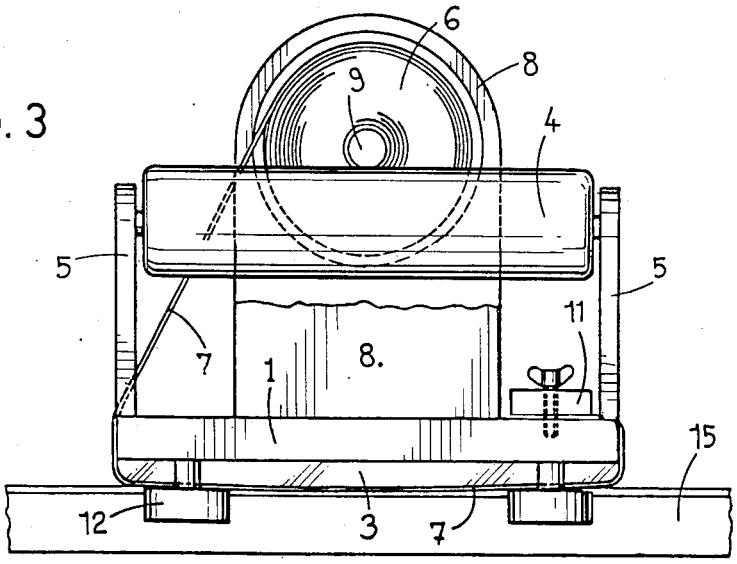

DEVICE FOR FINISHING THE EDGES OF SKIS

This application is a continuation-in-part of my copending application Ser. No. 556,168, filed Nov. 29, 1983, now abandoned.

BACKGROUND OF THE INVENTION

Most new skis leave the plant without having their lower lateral edges sharpened, finished or ground. The present skis being more and more efficient, any imperfection, burr, scratch, etc. on the lower lateral edges of the skis leads to defects especially as regards the easiness of guiding the skis.

The ski edges are then sharpened in order to give them a good behavior on ice and frozen snow. This sharpening is in fact a machining of the lateral face of an edge by means of a tool such as an abrasive band or a file. This manual operation is tricky, because the angle of the edge which has just been sharpened should not be rounded off, and because said operation should not leave any scratch or score on the lower surface of the edge which would be prejudicial to a good guiding of the ski.

SUMMARY OF THE INVENTION

The finishing device according to the invention allows manually or automatically carrying out with best quality and with less qualified manpower the operation of clearing off the burr, and further allows polishing the lower surface of the edges.

The present device is characterized by the fact that it comprises a base plate, displaceable relatively to the gliding surface of a ski, comprising on its lower face two longitudinal blocks located on opposite sides of the longitudinal axis of the device and the lower surfaces of which are inclined towards said longitudinal axis.

BRIEF DESCRIPTION OF THE DRAWINGS

The annexed drawings show schematically and by way of example two embodiments of the finishing device according to the invention.

FIG. 1 is a view of a first embodiment from an end thereof.

FIG. 2 is a view partly illustrating the position of a guiding roller relative to the ski.

FIG. 3 is a lateral view of the embodiment of FIG. 1.

DETAILED DESCRIPTION OF THE PREFERRED EMBODIMENT

Figure 4:
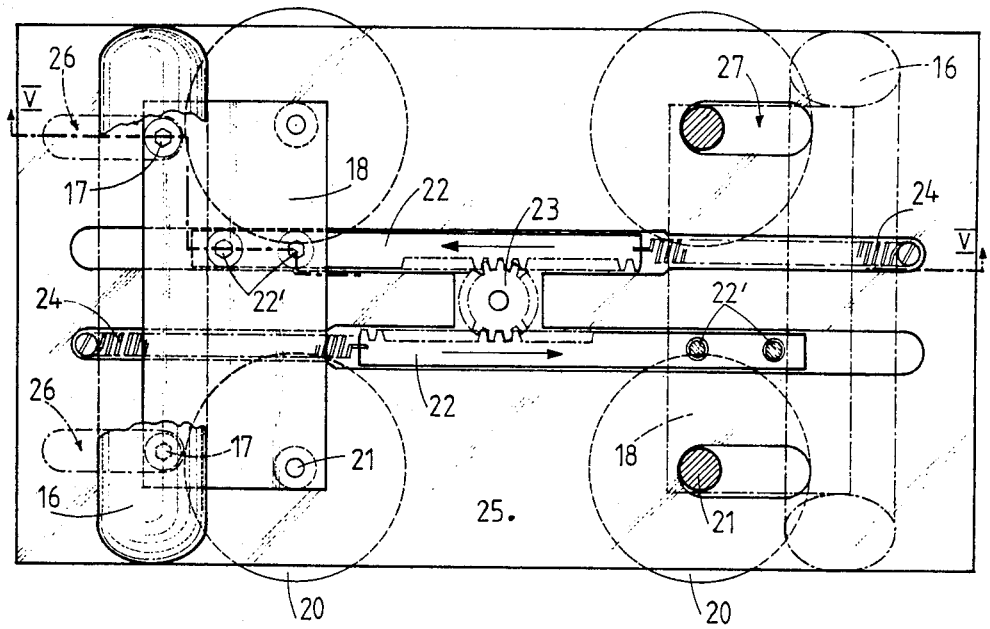
FIG. 4 is a top plan view, with parts broken away, of a second embodiment of a device according to the invention.

The device as shown in FIGS. 1–3 comprises a base plate 1 on the lower face of which two longitudinal blocks 2,3 are fixed having a width of about 25 mm.

The distance L between the external lateral borders of these blocks is at least equal to the maximum width of the ski or skis to be treated, whereas the distance l between the internal lateral borders, facing each other, of these blocks is less than the minimum width of the ski or skis to be treated by at least several millimeters.

The free lower face of each block 2,3 is slightly inclined relative to the plane of the plate 1, by about 0.5° to 3°, but preferably of 1° to 2°, in order that the lower surfaces of the blocks are inclined towards the longitudinal axis of the device.

The device further comprises two cylindrical handles 4 fixed by standards 5 to the upper face of the base plate 1.

Two reels 6 of an abrasive band or strip 7 are journalled on supports comprising each two flanges 8 interconnected by a shaft 9 serving as pivot to said reels 6. These supports are also fixed to the upper face of the base plate 1 and centered on the longitudinal axis of each block 2,3.

A lock device, for example a pin 10 introduced within borings of a flange and a flank of the reel 6, allows fixing the angular position of said reel relative to its support.

The abrasive strip 7 passes around one end of the base plate 1 and is applied against a block 2,3, then returns around the other end of the base plate 1 so as to be attached within a clamping device 11. Thus an abrasive band is tightened and applied against the lower surface of each block 2,3. The lower surface of the blocks 2,3 is preferably slightly rounded in the longitudinal direction, but it can also be plane.

The lower face of the base plate 1 further comprises guiding rollers, preferably four, each constituted by a roller 12 rotatable on a shaft 13 fixed in the plate base. The cylindrical face of these rollers is intended to enter into contact with the lateral face of an edge 14 of a ski 15, while leaving free the zone of the sharp edge of said edge 14, as can be seen in FIG. 2. The distance between the rolling faces of a pair of rollers 12 is equal to the distance L between the external sides of the blocks 2,3 and corresponds to the greatest width of a ski 15.

The abrasive bands 7 have a granular size comprised between about 150 and 220 mesh according to the desired finishing.

Once the edges of a ski have been sharpened, the finishing operation consists in urging the abrasive bands 7 borne by the blocks 3 against the lower surface of a ski and in displacing the device along this ski.

This operation can be carried out the number of times necessary to remove any burr formed by the sharpening, to polish the lower surface of the edges 14 of the ski, and to give to said lower surface of the ski a slight chamfer, corresponding to the inclination of the blocks, in a lateral zone near the edges 14. A new ski thus prepared allows a much easier guiding.

In a non-illustrated embodiment, the blocks 2,3 can be removably fixed on the base plate 1. When these blocks are removed, it is possible to replace them by files, the active surface of which also forms an angle of 1° to 2° with the base plate. The device thus provided with files can be employed for putting again in good state used skis the edges of which have been scratched. The device also allows precisely re-positioning the scratched edges. A finishing operation can always be carried out by means of the blocks with their abrasive bands.

Figure 5:
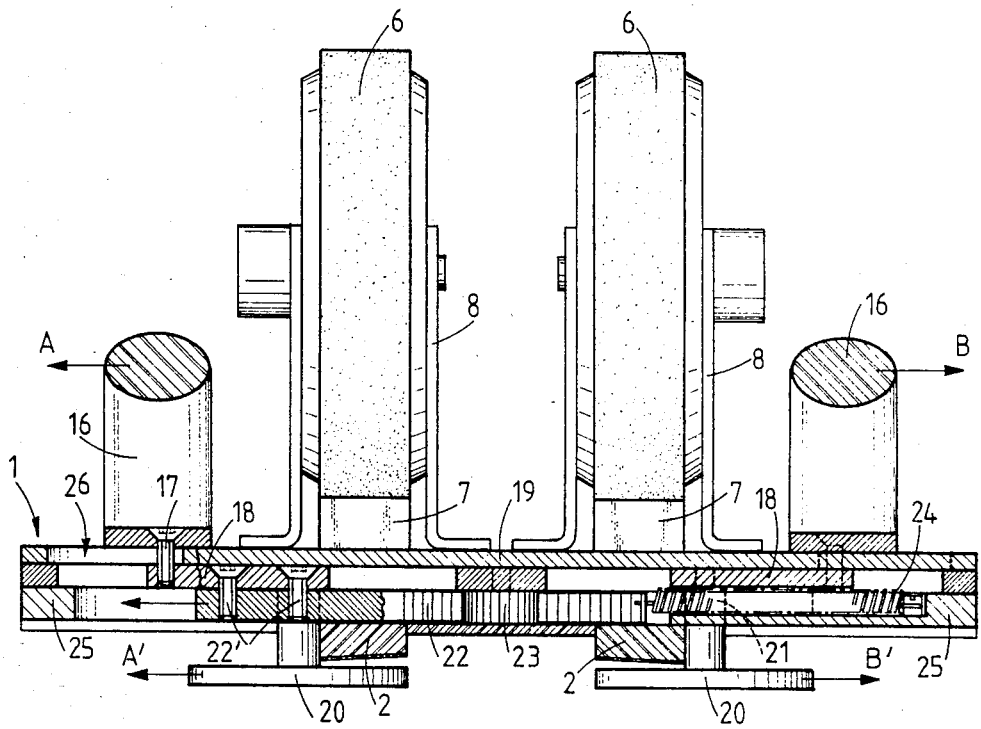
FIG. 5 is a cross-sectional view on the line V—V of FIG. 4.

According to the embodiment shown in FIGS. 4 and 5, the device of the invention comprises two handles 16 which perform a dual function of respectively resiliently applying the guiding rollers against the lateral faces of the ski and moving the device lengthwise of the ski.

Thus, both handles 16 of inverted U-shape are fixed by screws 17 on two sliding plates 18, which are transversely movable in a horizontal plane under the upper plate 19 of the base 1 of the device. Two guiding rollers 20 are rotatably mounted by screws 21 on the lower face of each sliding plate 18, and sliding plates 18 are interconnected by two straight racks 22, the teeth of which mesh with a toothed disc 23. More particularly one rack 22 is fixed by screws 22' to each sliding plate 18 by one of its ends, the other end being attached to a spring 24 which is fixed to the lower plate 25 of the base 1.

Therefore, in the position illustrated in FIGS. 4 and 5, both guiding rollers 20 are applied against the lateral faces of the ski (not shown) and resiliently pressed there against by springs 24. The device is thus in working position, and can be moved lengthwise of the ski by the user pushing or pulling it by means of the handles 16.

When the user wishes to remove the device from the ski, he has merely to spread apart the handles 16, against the resilient action of the springs 24, that is in the direction of the arrows A and B, thereby correspondingly to displace the guiding rollers 20 (in the direction of arrows A' and B'). The path of movement of the handles 16 and rollers 20 is limited by the length of the slots 26 provided in the upper plate 19 of the base 1, through which the screws 17 pass between each handle and its corresponding sliding plate 18, and by the length of the slots 27 provided in the lower plate 25 of the base 1 through which the vertical shafts of the rollers 20 pass.

Other embodiments of the device can be foreseen. For example it can be attached to a movable carriage of a machine which would automatically control its displacements. It is also possible to have a fixed device and that the ski is displaced relative thereto, either manually or automatically.

By means of this device, it is possible to finish a new ski or to put again in a good state a used ski, easily and especially avoiding any manual working with a file which necessitates a qualified worker.

What is claimed is:

1. Device for finishing the edges of a ski, comprising a base plate adapted to be moved along the sliding surface of the ski, the base plate having on its lower face two blocks disposed on opposite sides of the device, said blocks having finishing surfaces thereon, lateral guiding members bearing in working position against the side faces of the edges of the ski, handles on the upper side of the base plate for moving the device lengthwise of the ski, the handles being transversely movable toward and away from each other and being connected with said lateral guiding members to move the lateral guiding members toward and away from each other with the handles, means resiliently urging the handles toward each other, and sliding plates one on each side of the device and mounted for sliding movement on said base plate, there being a said handle and a said lateral guiding member secured to each sliding plate.

2. A device as claimed in claim 1, in which said handles are of inverted U-shape and have horizontal handgrips that extend in the direction of movement of the device along the ski.

3. A device as claimed in claim 1, the sliding plates being connected to each other by means of a rack secured to each sliding plate, the racks being parallel to each other and meshing with a common pinion that is secured to the base plate for rotation about a vertical axis.

* * * * *